US009835016B2

(12) United States Patent
Zhang et al.

(10) Patent No.: US 9,835,016 B2
(45) Date of Patent: Dec. 5, 2017

(54) METHOD AND APPARATUS TO DELIVER A REAGENT TO A DOWNHOLE DEVICE

(71) Applicant: Baker Hughes Incorporated, Houston, TX (US)

(72) Inventors: Zhihui Zhang, Katy, TX (US); Yingqing Xu, Tomball, TX (US); Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1 day.

(21) Appl. No.: 14/723,831

(22) Filed: May 28, 2015

(65) Prior Publication Data

US 2016/0160611 A1 Jun. 9, 2016

Related U.S. Application Data

(63) Continuation-in-part of application No. 14/561,523, filed on Dec. 5, 2014.

(51) Int. Cl.
*E21B 29/02* (2006.01)
*E21B 43/14* (2006.01)

(52) U.S. Cl.
CPC ..... *E21B 43/14* (2013.01)

(58) Field of Classification Search
CPC ..... E21B 43/14; E21B 29/02
See application file for complete search history.

(56) References Cited

U.S. PATENT DOCUMENTS 5,479,986 A * 1/1996 Gano ..... E21B 23/00 166/192
5,607,017 A * 3/1997 Owens ..... E21B 33/12 166/288
7,699,101 B2 * 4/2010 Fripp ..... E21B 33/1208 166/205
8,403,037 B2 * 3/2013 Agrawal ..... E21B 23/04 166/193
8,535,604 B1 9/2013 Baker et al.
8,584,746 B2 * 11/2013 Marya ..... E21B 33/12 166/192
2007/0107908 A1 5/2007 Vaidya et al.
2010/0294510 A1 11/2010 Holmes
(Continued)

OTHER PUBLICATIONS

PCT International Search Report and Written Opinion; International Application No. PCT/US2016/034581; International Filing Date: May 27, 2016; dated Sep. 2, 2016; pp. 1-15.

*Primary Examiner* — Matthew R Buck
(74) *Attorney, Agent, or Firm* — Cantor Colburn LLP

(57) ABSTRACT

In one aspect, a downhole device for use in a downhole environment is disclosed, including: a first material with a first degradation rate in the downhole environment and at least one cavity, wherein the at least one cavity contains a second material to degrade the first material at a second degradation rate when the second material is exposed to the downhole environment and the first material, the second degradation rate being higher than the first degradation rate. In certain embodiments, the second material is a solid second material. In certain embodiments, the second material is a gel second material. In certain embodiments the downhole device further includes a protective material to control exposure of the second material to the downhole environment.

15 Claims, 2 Drawing Sheets

(56) References Cited

U.S. PATENT DOCUMENTS

| | | | | |
|---|---|---|---|---|
| 2011/0067889 | A1 | 3/2011 | Marya et al. | |
| 2011/0132620 | A1* | 6/2011 | Agrawal | E21B 23/04 166/376 |
| 2012/0273229 | A1* | 11/2012 | Xu | E21B 23/00 166/376 |
| 2012/0292053 | A1 | 11/2012 | Xu et al. | |
| 2013/0048305 | A1* | 2/2013 | Xu | E21B 23/01 166/376 |
| 2013/0118759 | A1* | 5/2013 | Crews | E21B 29/00 166/376 |
| 2013/0146302 | A1* | 6/2013 | Gaudette | E21B 31/002 166/376 |
| 2013/0299192 | A1 | 11/2013 | Xu et al. | |
| 2013/0327545 | A1 | 12/2013 | Marya et al. | |
| 2014/0014339 | A1 | 1/2014 | O'Malley et al. | |
| 2014/0027127 | A1 | 1/2014 | Frazier et al. | |
| 2014/0190685 | A1 | 7/2014 | Frazier et al. | |
| 2014/0190705 | A1 | 7/2014 | Fripp et al. | |
| 2015/0129239 | A1 | 5/2015 | Richard | |
| 2015/0247376 | A1* | 9/2015 | Tolman | E21B 33/12 166/297 |

* cited by examiner

METHOD AND APPARATUS TO DELIVER A REAGENT TO A DOWNHOLE DEVICE

CROSS-REFERENCE TO RELATED APPLICATIONS

This patent application is a Continuation-In-Part Application of U.S. Non-Provisional patent application Ser. No 14/561,523, filed Dec. 5, 2014 which is incorporated herein by reference in its entirety.

BACKGROUND

Field of the Disclosure

This disclosure relates generally to degradable devices with reagents and systems that utilize the same for downhole applications.

Background of the Art

Wellbores are drilled in subsurface formations for the production of hydrocarbons (oil and gas). Hydrocarbons are trapped in various traps or zones in the subsurface formations at different depths. In many operations, such as fracturing, it is required to convey devices (such as packers, bridge plugs, etc.) in a downhole location to facilitate production of oil and gas. After such operations, conveyed devices must be removed or destroyed before following operations can begin. Such removal operations may be costly and/or time consuming. It is desired to provide a downhole device that can provide desired and predictable degradation characteristics without additional removal or treatment operations.

The disclosure herein provides degradable devices with reagents and systems using the same for downhole applications.

SUMMARY

In one aspect, a downhole device for use in a downhole environment is disclosed, including: a first material that degrades at a first rate when exposed to the downhole environment, and a second material protected from the downhole environment, wherein the second material when exposed to the downhole environment degrades the first material at a second rate greater than the first rate.

In another aspect, a method to degrade a downhole device in a downhole environment, is disclosed, including: providing a first material in the downhole environment; providing a second material protected from the downhole environment; degrading the first material at a first rate in response to exposure to the downhole environment; exposing the second material to the downhole environment and the first material; and degrading the first material at a second rate in response to exposure to the downhole environment and the second material, wherein the second rate is greater than the first rate.

In another aspect, a downhole system for use in a downhole environment, is disclosed, including a casing string; and a downhole device associated with the casing string, including a first material that degrades at a first rate when exposed to the downhole environment, and a second material protected from the downhole environment, wherein the second material when exposed to the downhole environment degrades the first material at a second rate greater than the first rate.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
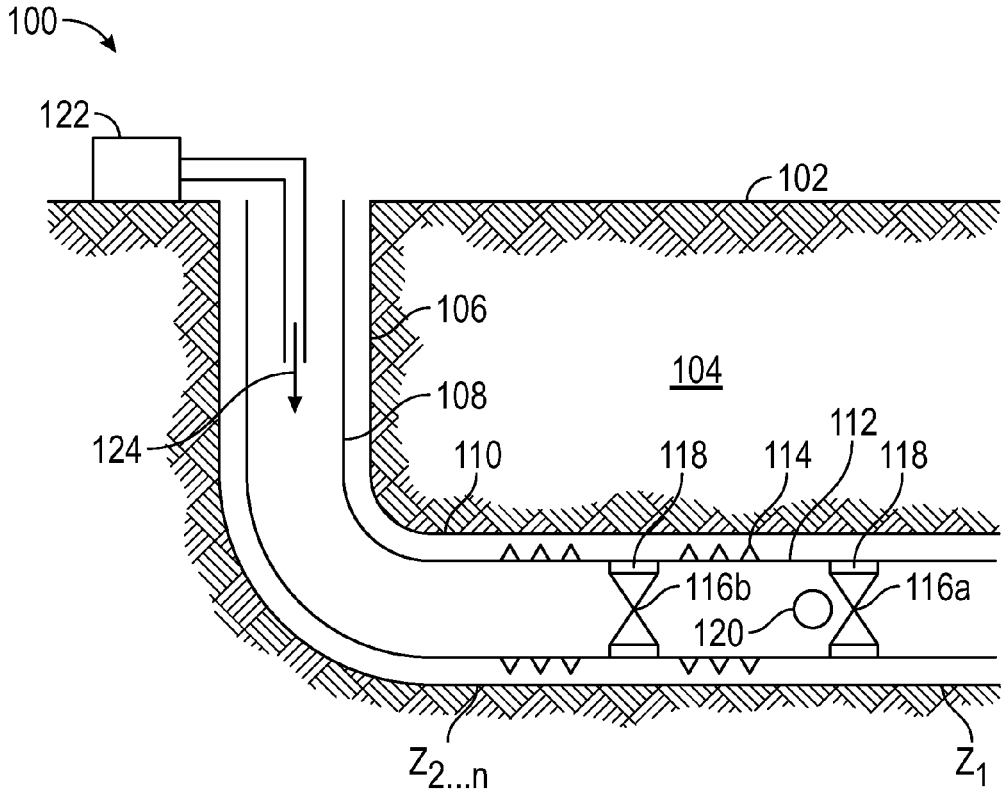
FIG. 1 is a schematic diagram of an exemplary drilling system that includes downhole elements according to embodiments of the disclosure.

FIG. 1 shows an exemplary embodiment of a downhole system to facilitate the production of oil and gas. In certain embodiments, system 100 allows for fracturing operations to facilitate production of oil and gas. System 100 includes a wellbore 106 formed in formation 104 with casing 108 disposed therein.

In an exemplary embodiment, a wellbore 106 is drilled from a surface 102 to a downhole location 110. Casing 108 may be disposed within wellbore 106 to facilitate production. In an exemplary embodiment, casing 108 is disposed through multiple zones of production Z1 . . . Zn in a downhole location 110. Wellbore 106 may be a vertical wellbore, a horizontal wellbore, a deviated wellbore or any other suitable type of wellbore or any combination thereof.

To facilitate downhole operations, such as fracturing operations, bridge plugs 116*a*, packers 116*b*, or other suitable downhole devices are utilized within casing string 108. In certain embodiments, such downhole devices 116*a,b* are anchored to casing string 108 via an anchor assembly 118. In certain embodiments, bridge plugs 116*a* utilize an anchor assembly 118 and frac balls 120 to isolate zones Z1 . . . Zn for fracturing operations. In certain embodiments, frac balls 120 are disposed at a downhole location 110 to obstruct and seal fluid flow in local zone 112 to facilitate flow to perforations 114 in conjunction with frac plugs 116*a*. In certain embodiments, packers 116*b* are utilized in conjunction with anchor assembly 118 to isolate zones Z1 . . . Zn for fracturing operations.

In certain embodiments, frac fluid 124 is pumped from a frac fluid source 122 to a downhole location 110 to flow through perforations 114 in a zone 112 isolated by downhole device 116*a,b*. Advantageously, fracturing operations allow for more oil and gas available for production.

After desired operations (such as fracturing operations) and before following operations, downhole devices 116*a,b* are often removed or otherwise destroyed to allow the flow of oil and gas through casing 108. In an exemplary embodiment, downhole devices 116*a,b* are configured remain resident in casing 108 of local zone 112 until a predetermined time at which at least portions of downhole devices 116*a,b* dissolve or degrade to facilitate the production of oil and gas. Advantageously, in an exemplary embodiment, the downhole devices 116*a,b* herein utilize reagents conveyed with the downhole devices 116*a,b* to accelerate degradation of downhole devices 116*a,b* while allowing for suitable performance.

Figure 2:
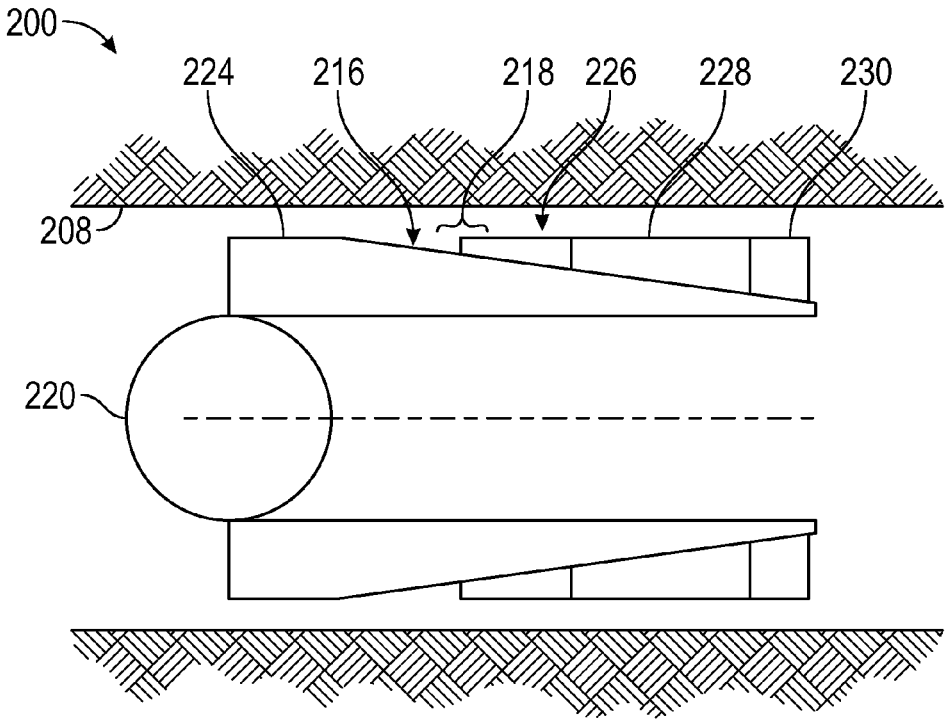
FIG. 2 is a schematic diagram of an exemplary downhole device for use in a downhole system, such as the one shown in FIG. 1, according to one embodiment of the disclosure.

FIG. 2 shows a downhole device 216, such as a bridge plug, packer, or any other suitable downhole device, for use downhole systems such as the system 100 shown in FIG. 1. In an exemplary embodiment, downhole system 200 includes downhole device 216 interfacing with casing 208 via anchor assembly 218 to anchor a downhole device 216. In certain embodiments, a frac ball 220 is used with downhole device 216 to isolate frac fluid flow within the wellbore.

In an exemplary embodiment, anchor assembly 218 includes a wedge 224, slip ring 228, and bottom sub 230. In certain embodiments, wedge 224 is forced downhole to force slip ring 228 outward against casing 208 to anchor against casing 208. In certain embodiments, slip ring 228 can crack or otherwise separate as it is driven against casing 208. In certain embodiments, wedge 224 is forced via a setting tool, explosives, or any other suitable means. In certain embodiments, downhole device 216 further utilizes a sealing member 226 to seal downhole device 216 against casing 208 and further resist movement. Sealing member 226 may similarly be driven toward casing 208 via wedge 224. In certain embodiments, downhole device 216 can further utilize bottom sub 230 to interface against casing 208 and further resist movement.

In an exemplary embodiment, a substrate of one or more elements of downhole device 216 are formed of a degradable material to allow one or more elements of downhole device 216 to dissolve or degrade after a desired anchoring function is performed. In certain embodiments, the downhole temperature exposure to downhole device 216 varies from 100 to 350 degrees Fahrenheit at a particular downhole location for a given area. Advantageously, one or more elements of downhole device 216 as described herein may contain reagents conveyed with one or more elements of downhole device 216 to allow for rapid degradation of one or more elements of downhole device 216 after a desired time in certain downhole environments, while allowing suitable anchoring performance.

Figure 3:
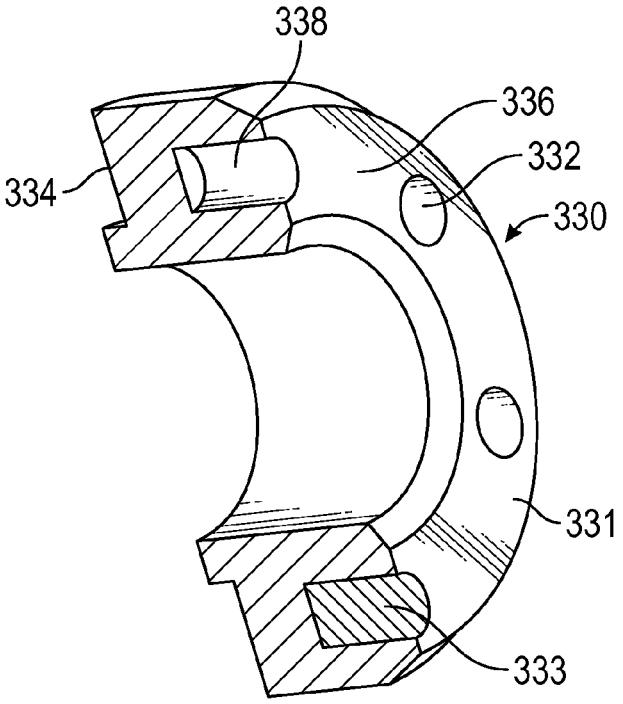
FIG. 3 shows a partial view of an exemplary bottom sub for use with a downhole device, such as the downhole device shown in FIG. 2 for use with a downhole system, according to one embodiment of the disclosure.

FIG. 3 shows an exemplary embodiment of bottom sub 330. While an illustrated embodiment depicts a bottom sub 330, the features described herein are suitable for any element of downhole device 216. In an exemplary embodiment, bottom sub 330 is formed of a substrate 331 and includes cavities 332. In certain embodiments, bottom sub 330 is used with downhole devices as shown in FIG. 2. Advantageously, bottom sub 330 is a degradable device and includes a reagent 333 to be conveyed with bottom sub 330 to expedite degradation of bottom sub 330, other elements of downhole device 216, or any other suitable element formed of degradable materials. In an exemplary embodiment, any suitable elements of downhole device 216 can be utilized as described to convey reagent 333 and release reagent 333.

In an exemplary embodiment, bottom sub 330 includes an upper face 334, a lower face 336, and one or more cavities 332. Bottom sub 330 can be utilized with elements of one or more elements of downhole device 216 to provide reagent 333 to one or more elements of downhole device 216. In an exemplary embodiment, the features of bottom sub 330, including upper face 334 and lower face 336 can be configured to interface with one or more elements of downhole device 216.

In an exemplary embodiment, bottom sub is generally formed from substrate 331. In an exemplary embodiment, substrate 331 is a degradable material. Advantageously, by forming one or more elements of downhole device 216 from a degradable material, a downhole device 216 may be remain resident downhole for a desired period of time, and then may be disintegrated to allow further operations without any obstructions. In an exemplary embodiment, substrate 331 and consequently bottom sub 330 can degrade at a first rate in response to conditions found in a downhole environment.

In certain embodiments, substrate 331 is formed from a corrodible metal such as a controlled electrolytic metallic, including but not limited to Intallic. Substrate 331 materials may include: a magnesium alloy, a magnesium silicon alloy, a magnesium aluminum alloy, a magnesium zinc alloy, a magnesium manganese alloy, a magnesium aluminum zinc alloy, a magnesium aluminum manganese alloy, a magnesium zinc zirconium alloy, and a magnesium rare earth element alloy. Rare earth elements may include, but is not limited to scandium, yttrium, lanthanum, cerium, praseodymium, neodymium, and erbium. In certain embodiments, substrate materials 331 are further coated with aluminum, nickel, iron, tungsten, copper, cobalt. In certain embodiments, substrate 331 materials are consolidated and forged. In certain embodiments, the elements can be formed into a powder and a substrate can be formed from pressed powder. In an exemplary embodiment, the material of substrate 331 is selected based on desired degradation characteristics of one or more elements of downhole device 216.

In an exemplary embodiment, bottom sub 330 includes at least one cavity 332. Cavities 332, also referred to as pockets, can be of any shape, any number and disposed anywhere along elements of downhole device 216. In an exemplary embodiment, cavities 332 can be disposed in non-integral portions of bottom sub 330, such as non-load bearing portions. In certain embodiments, cavities 332 are not utilized in high stress areas to avoid unintentional or uncontrolled release of reagent 333. In an exemplary embodiment, cavities 332 are sealed to control the release and interaction of reagent 333 with the downhole environment and substrate 331.

In an exemplary embodiment, cavities 332 contain reagent 333. Advantageously, reagent 333 is conveyed with one or more elements of downhole device 216 to allow reagent 333 to be released without additional operations. In an exemplary embodiment, reagents 333 include, but are not limited to acidic oxides, acidic salts, neutral salts, and basic salts. Acidic oxides can include, but are not limited to sulfur dioxide, sulfur trioxide, chromium trioxide, phosphorus pentoxide, etc. Acidic salts can include, but are not limited to ammonium chloride, monosodium phosphate, sodium bisulfate, etc. Neutral salts can include, but are not limited to sodium chloride, sodium bromide, potassium chloride, potassium bromide, calcium chloride, calcium bromide, etc. Basic salts can include, but are not limited to sodium carbonate, sodium bicarbonate, etc. Any suitable reagent 333 can be selected in response to substrate 331 material, downhole environment conditions, and desired degradation rate.

In an exemplary embodiment, reagent 333 is stored as a solid. Advantageously, stored solid reagent 333 allows for high concentration levels of reagent 333 without unintentionally degrading substrate 331. In certain embodiments, reagent 333 can be a gel substance, including, but not limited to a gelled acid. In other embodiments, reagent 333 can be a liquid.

In an exemplary embodiment, after a desired time in a downhole environment, substrate 331 of bottom sub 330 degrades at a first rate. As substrate 331 degrades, cavities 332 formed therein are exposed to the downhole environment. Accordingly, reagent 333 resident in cavities 332 are exposed to the fluids and conditions of the downhole environment. In an exemplary embodiment, reagent 333 mixes with fluids within the downhole environment to form an electrolytic fluid. In an exemplary embodiment, the resulting electrolytic fluid degrades substrate 331 at a second rate. In certain embodiments, the substrate 331 exposed to the electrolytic fluid formed from reagent 333 can degrade at a second rate 2 to 1000 times faster than substrate 331 degrading exposed to a downhole environment alone.

In certain embodiments, cavities 332 can include a protective material 338. Protective material 338 can be a degradable material that degrades at a different rate than substrate 331 to control the mixing and release of reagent 333 and further prevent undesired release of reagent 333. In certain embodiments, protective material 338 can cover portions of cavity 332, all of cavity 332, or portions or all of reagent 333. Protective material 338 can include, but is not limited to polyurethane, Teflon, etc. In certain embodiments, protective material 338 can include a gel with a controlled or otherwise predetermined degradation. In certain embodiments, protective material 338 can include enteric coatings that are stable at low pH levels but can quickly degrade in neutral or alkaline environments.

Figure 4:
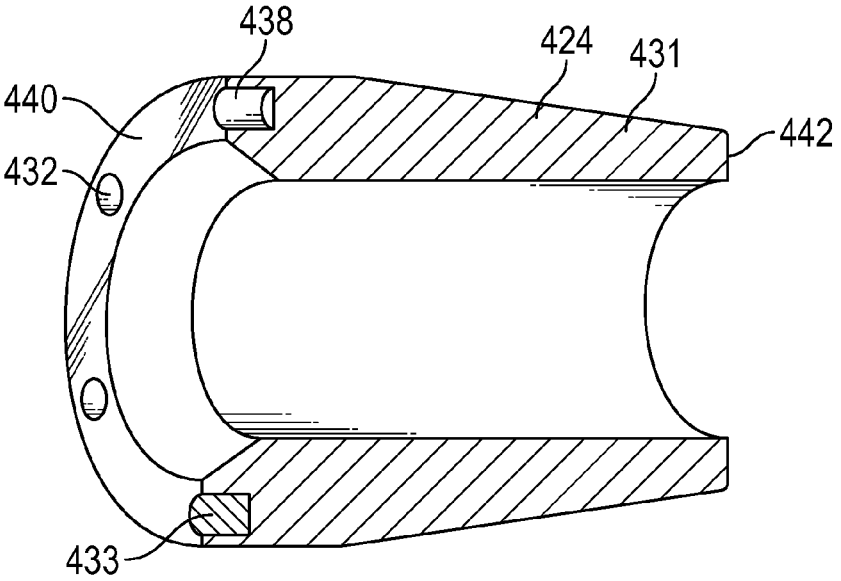
FIG. 4 shows a partial view of an exemplary cone for use with a downhole device, such as the downhole device shown in FIG. 2 for use with a downhole system, according to one embodiment of the disclosure.

FIG. 4 shows an exemplary embodiment of wedge 424. Similarly, wedge 424 can include cavities 432 with reagent 433. Similarly, cavities 432 can be disposed in non-integral portions of wedge 424 such as non-load bearing portions. In certain embodiments, the cavities 432 are lined with protective lining 438. In an exemplary embodiment, wedge 424 is formed of degradable substrate 431, having an upper face 440 and a lower face 442.

Therefore, in one aspect, a downhole device for use in a downhole environment is disclosed, including: a first material that degrades at a first rate when exposed to the downhole environment, and a second material protected from the downhole environment, wherein the second material when exposed to the downhole environment degrades the first material at a second rate greater than the first rate. In certain embodiments, a cavity is formed in the first material, wherein the cavity contains the second material. In certain embodiments, the second material is a solid second material. In certain embodiments, the second material is a gel second material. In certain embodiments the downhole device further includes a protective material to control exposure of the second material to the downhole environment. In certain embodiments, the protective material is formed of at least one of a group consisting of: Teflon and polyurethane. In certain embodiments, the second material is formed of at least one of a group consisting of: acidic oxides, acidic salts, neutral salts, and basic salts. In certain embodiments, the at least one cavity is disposed in a non-load bearing portion of the first material. In certain embodiments, the at least one cavity is disposed in a non-integral portion of the first material. In certain embodiments, the downhole device is a bottom sub. In certain embodiments, the downhole device is a cone.

In another aspect, a method to degrade a downhole device in a downhole environment, is disclosed, including: providing a first material in the downhole environment; providing a second material protected from the downhole environment; degrading the first material at a first rate in response to exposure to the downhole environment; exposing the second material to the downhole environment and the first material; and degrading the first material at a second rate in response to exposure to the downhole environment and the second material, wherein the second rate is greater than the first rate. In certain embodiments, the method further includes forming a cavity in the first material; and providing the second material within the cavity. In certain embodiments, the second material is a solid second material. In certain embodiments, the second material is a gel second material. In certain embodiments, the method further includes controlling exposure of the second material to the downhole environment via a protective material. In certain embodiments, the downhole device is a bottom sub. In certain embodiments, the downhole device is a cone.

In another aspect, a downhole system for use in a downhole environment, is disclosed, including a casing string; and a downhole device associated with the casing string, including a first material that degrades at a first rate when exposed to the downhole environment, and a second material protected from the downhole environment, wherein the second material when exposed to the downhole environment degrades the first material at a second rate greater than the first rate. In certain embodiments, a cavity is formed in the first material, wherein the cavity contains the second material.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A downhole device for use in a downhole environment, comprising:

a first material that degrades at a first rate when exposed to the downhole environment, wherein the first material forms a body of the downhole device, the first material forming a sealed cavity; and a second material in the cavity of the first material and protected from the downhole environment by the first material, wherein the second material is a solid material that forms an electrolytic fluid when exposed to fluids within the downhole environment, wherein the electrolytic fluid degrades the first material at a second rate greater than the first rate and the degradation of the first material of the body exposes the second material.

2. The downhole device of claim 1, wherein the second material is a gel second material.

3. The downhole device of claim 1, further comprising a protective material in the cavity to control exposure of the second material to the downhole environment.

4. The downhole device of claim 3, wherein the protective material is formed of at least one of a group consisting of: polytetrafluoroethylene and polyurethane.

5. The downhole device of claim 1, wherein the second material is formed of at least one of a group consisting of: acidic oxides, acidic salts, neutral salts, and basic salts.

6. The downhole device of claim 1, wherein the cavity is disposed in a non-load bearing portion of the first material.

7. The downhole device of claim 1, wherein the cavity is disposed in a non-integral portion of the first material.

8. The downhole device of claim 1, wherein the downhole device is a bottom sub.

9. The downhole device of claim 1, wherein the downhole device is a cone.

10. A method to degrade a downhole device in a downhole environment, comprising:

providing a first material in the downhole environment wherein the first material forms a body of the downhole device, the first material forming a sealed cavity;

providing a second material in the cavity of the first material and protected from the downhole environment by the first material, wherein the second material is a solid material that forms an electrolytic fluid when exposed to fluids within the downhole environment;

degrading the first material at a first rate in response to exposure to the downhole environment, wherein the degradation of the first material of the body exposes the second material;

exposing the second material to the downhole environment and the first material; and degrading the first material at a second rate in response to exposure to the electrolytic fluid, wherein the second rate is greater than the first rate.

11. The method of claim 10, wherein the second material is a gel second material.

12. The method of claim 10, further comprising controlling exposure of the second material to the downhole environment via a protective material in the cavity.

13. The method of claim 10, wherein the downhole device is a bottom sub.

14. The method of claim 10, wherein the downhole device is a cone.

15. A downhole system for use in a downhole environment, comprising:

a casing string; and a downhole device associated with the casing string, comprising:

a first material that degrades at a first rate when exposed to the downhole environment, wherein the first material forms a body of the downhole device, the first material forming a sealed cavity; and a second material in the cavity of the first material and protected from the downhole environment by the first material, wherein the second material is a solid material that forms an electrolytic fluid when exposed to fluids within the downhole environment, wherein the electrolytic fluid degrades the first material at a second rate greater than the first rate and the degradation of the first material of the body exposes the second material.

* * * * *